US006611974B2

(12) United States Patent
Roit et al.

(10) Patent No.: US 6,611,974 B2
(45) Date of Patent: Sep. 2, 2003

(54) MATTRESS TRANSPORT MECHANISM

(76) Inventors: Abraham M. Roit, Eva Poron Avenue 1311, Buenos Aires (AR); Silvia D. Sorokin, Eva Peron Avenue 1311, Buenos Aires (AR)

( * ) Notice: Subject to any disclaimer, the term of this patent is extended or adjusted under 35 U.S.C. 154(b) by 158 days.

(21) Appl. No.: 09/789,396

(22) Filed: Feb. 20, 2001

(65) Prior Publication Data

US 2001/0020304 A1 Sep. 13, 2001

(30) Foreign Application Priority Data

Feb. 21, 2000 (AR) ..... P 00 01 00727

(51) Int. Cl.[7] ..... A61G 7/08
(52) U.S. Cl. ..... 5/81.1 C; 5/611
(58) Field of Search ..... 5/611, 11, 610, 5/81.1 R, 81.1 C, 81.1 HS

(56) References Cited

U.S. PATENT DOCUMENTS 3,493,979 A * 2/1970 Koll et al. ..... 5/81.1 C
3,579,672 A * 5/1971 Koll et al. ..... 5/81.1 C
3,593,351 A * 7/1971 Dove ..... 5/88.1
3,765,037 A * 10/1973 Dunkin ..... 5/81.1 C
3,837,470 A * 9/1974 Dunkin ..... 198/750.8
3,854,152 A * 12/1974 Chez ..... 5/81.1 C
3,947,902 A * 4/1976 Conde et al. ..... 5/81.1 C
3,967,328 A * 7/1976 Cox ..... 5/81.1 C
4,262,375 A * 4/1981 Lilienthal ..... 5/81.1 HS
4,761,841 A * 8/1988 Larsen ..... 5/81.1 C
5,390,379 A * 2/1995 Palmer, Jr. et al. ..... 5/81.1 C
2001/0020304 A1 * 9/2001 Roit et al. ..... 5/611

* cited by examiner

*Primary Examiner*—Robert G. Santos
(74) *Attorney, Agent, or Firm*—Lahive & Cockfield, LLP

(57) ABSTRACT

A transport mechanism for supporting and laterally moving a bed mattress over the bed frame. The bed frame is divided between a longitudinally extending central frame and a longitudinally extending lateral frame pivoted thereto. Chain drives mounted in the head and foot of the central and lateral frames are attached to the head and foot ends of a flexible mattress support. The lateral frame is pivotal to cause the courses of the chains over the lateral frame to form variably adjustable angles with the courses thereof over the central frame.

14 Claims, 11 Drawing Sheets

MATTRESS TRANSPORT MECHANISM

BACKGROUND OF THE INVENTION

This invention relates generally to bed frames, and more particularly to mattress support structures including mechanisms for laterally transporting a mattress relative to the bed frame and selectively elevating portions of the mattress for rolling or turning a patient.

In the care of infirm bedridden patients it is necessary to change the position of the patient on the mattress for a number of reasons. These include moving the patient onto the bed from a wheelchair or other transport means, or from the bed onto such means, changing the position of the patient for therapeutic purposes, moving the patient on the bed to clean the patient or to change the bed clothes, and moving the patient to mitigate the necrosis of tissues such as bed sores and lesions resulting from protracted bedridden states.

The difficulties of accomplishing these movements vary with the condition of the patient. Examples of the variety of patients include quadriplegics, patients having Alzheimer's disease, extremely feeble persons, and extremely heavy persons. Typically, such movements of patients take place on a periodic basis, and there is a need to accomplish the movements with minimal disturbance of the patient, and particularly of the patient's sleep patterns.

The availability of caregivers is often limited, possibly including only members of the patient's family, and often only individuals having limited strength for moving the patient in the desired manner.

Accordingly, it is a principal object of the present invention to provide a mattress transport mechanism adapted for mechanically changing the position of a patient with respect to the surface of the mattress in a safe and secure manner with minimum physical exertion on the part of the caregiver.

A second object is to provide a mattress transport mechanism having a drive adapted to be controlled by computer programs for predetermined and/or periodic changes in the patient's position on the mattress.

An additional object of the invention is to provide means for elevating and lowering the mattress and for tilting the head relative to the foot of the mattress for therapeutic purposes such as improving bronchial drainage, reduction of endocranial pressure, X-rays, or improvement of the patient's psychological condition.

Prior art methods of accomplishing some of the foregoing objects include the use of rubber rings, sheepskin or other elements placed between the mattress and the patient. These methods have obvious limited utility in many practical instances. Similarly, waterbeds are limited by the inability to provide precise, controlled movement of the patient.

BRIEF SUMMARY OF THE INVENTION

With the above objects and others hereinafter appearing in view, the features of this invention include a bed frame that is divided between a longitudinally extending central frame and one or two longitudinally extending lateral frames pivoted to one or both sides of the central frame. Chain drives are mounted in the head and foot of the central and lateral frames, and the chains are attached to the head and foot ends of a flexible, longitudinally extending mattress support. The lateral frame or frames is or are pivotal on the central frame to cause the courses of the chains over the lateral frame or frames to form variable angles with the courses thereof over the central frame. This movement produces lateral prominences on the mattress for mechanically rolling the patient relative thereto.

An important feature of the invention is that the chain drives can be driven with little or no effort on the part of the caregiver, regardless of the weight of the patient.

Another feature is that the chain drives are adapted to be motor driven, and may be operated by automatic means including computer programs which may be set for controlled and/or periodic operation at variable intervals of operation.

A further feature is that the mattress transport mechanism is adapted for the further inclusion of lower frame elements permitting the central and lateral frames to be raised or lowered, and for the head end to be raised or lowered with respect to the foot end for therapeutic purposes.

The foregoing and other features of the invention are described in connection with the embodiment thereof shown in the accompanying drawings, and hereinafter described.

DRAWINGS

DESCRIPTION OF THE PRESENTLY PREFERRED EMBODIMENTS

Figure 7:
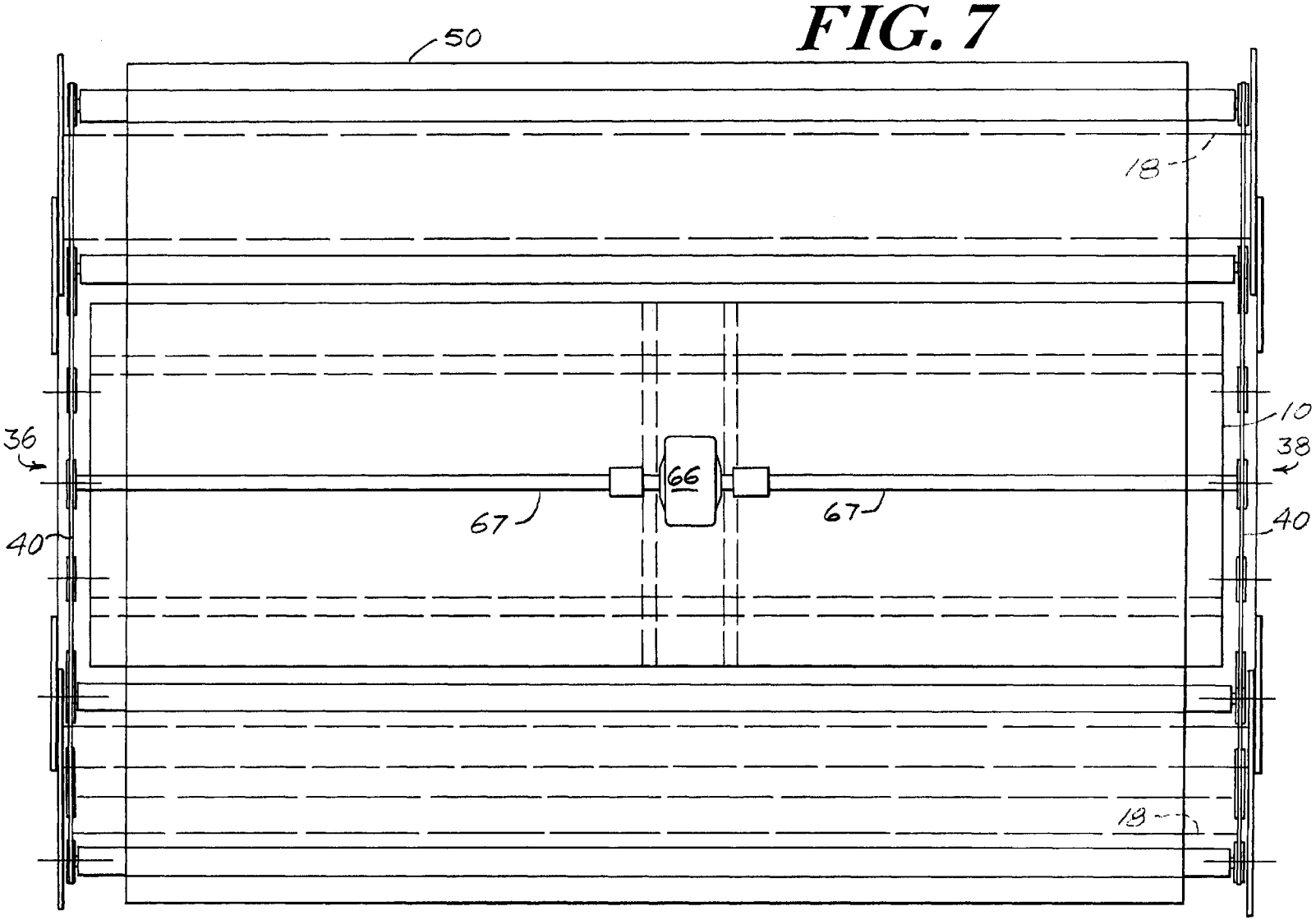
FIG. 7 is a plan view showing the central and lateral frames in the horizontal position and the chain drives according to this invention.
Figure 8:
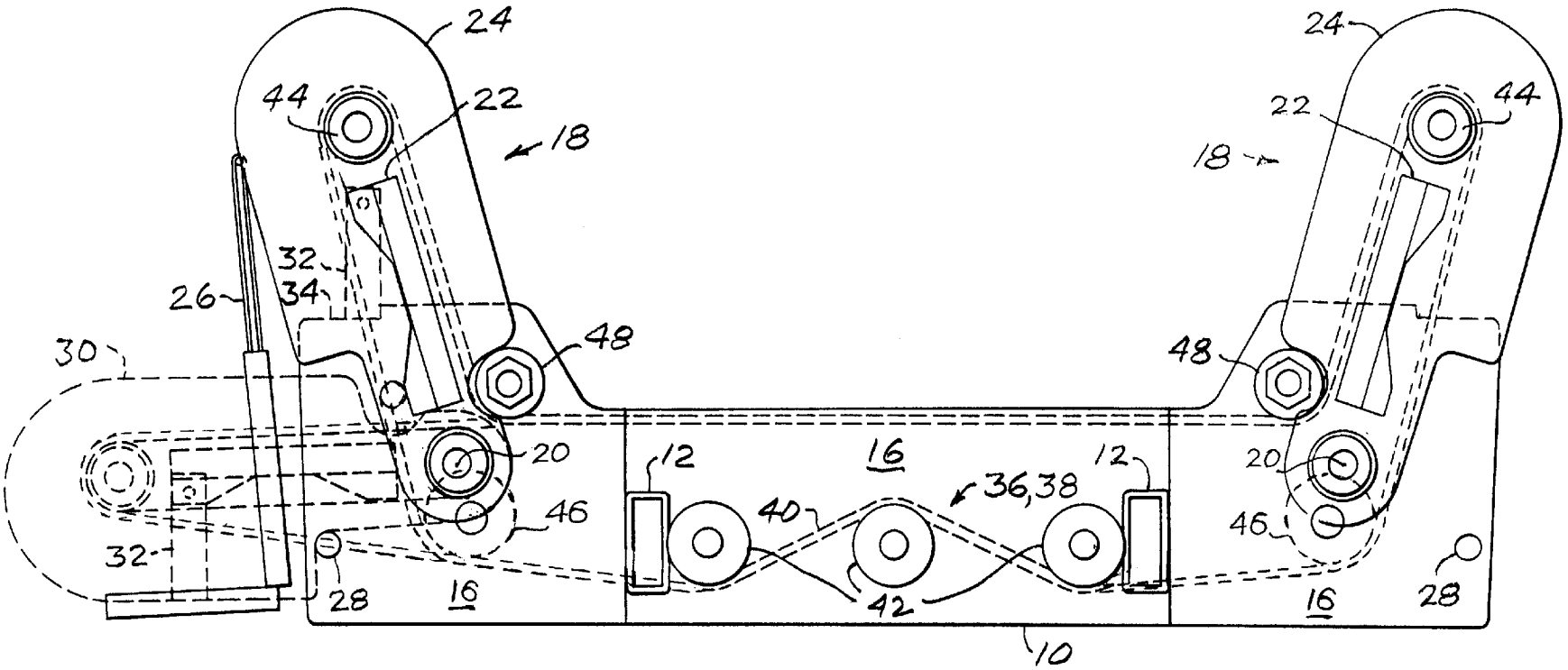
FIG. 8 is an end elevation showing the central and lateral frames with the latter in their fully elevated positions.
Figure 8A:
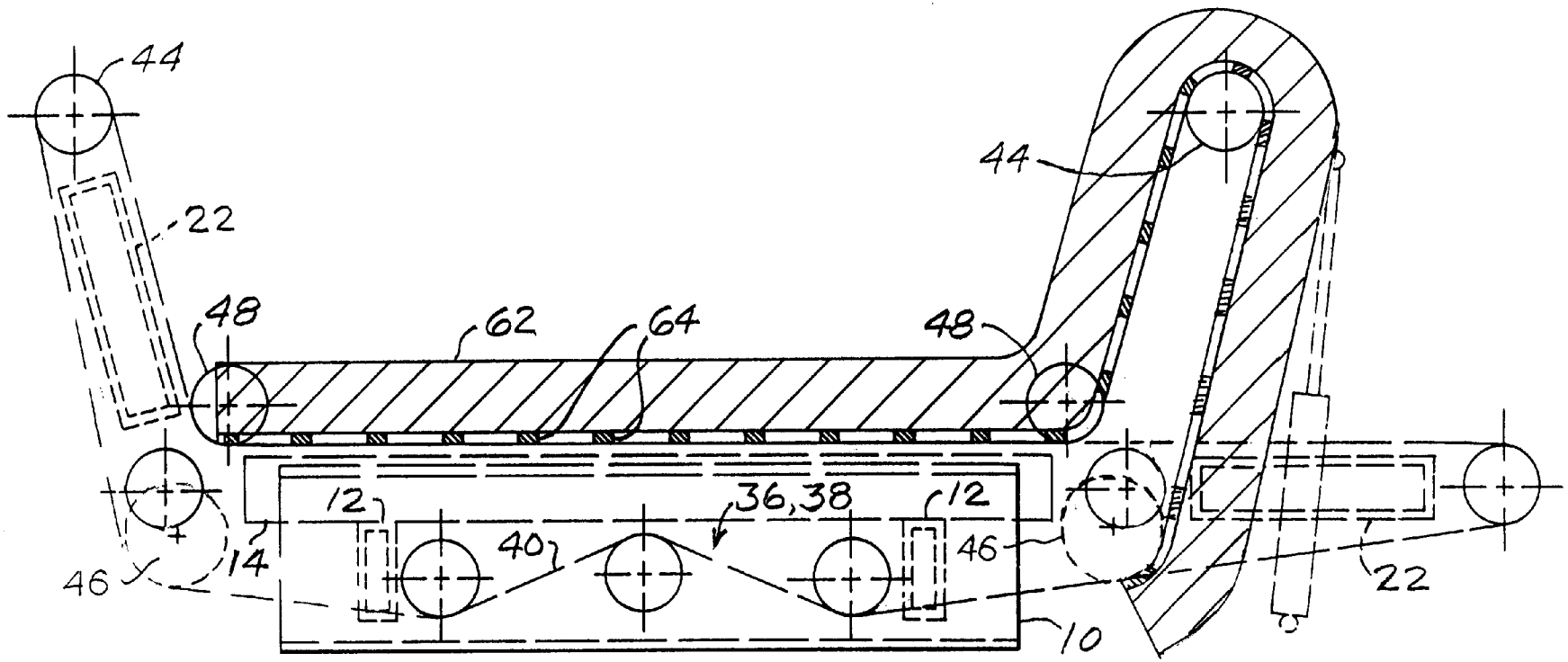
FIG. 8A is a transverse elevation partly in section showing the lateral frames in elevated positions.

In the following description, "longitudinal" refers to the direction of the length of the bed, i.e. the direction from the head to the foot. A central frame 10, best illustrated in FIGS. 7, 8 and 8A, comprises a pair of longitudinally extending box beams 12, a longitudinally extending platform 14 and head and foot end plates 16 forming a rigid structure.

A pair of lateral frames 18 are pivotally supported on axes 20 (FIG. 8) in the end plates 16. Although two lateral frames are illustrated in the drawings, it will be apparent that either of the lateral frames may be eliminated if only one is desired. Preferably, the structures of the lateral frames are essentially identical, allowing movement of the patient to be controlled from either side of the bed. The lateral frames each include box shaped, longitudinally extending members 22 attached to end plates 24.

Pressure actuated piston means 26, either hydraulic or pneumatic, are attached to the central frame 10 and adapted for selectively urging each lateral frame toward an elevated position relative to the central frame. Pins 28 in the central frame abut the plates 24 to define the lowermost, horizontal position of the lateral frame, illustrated in broken lines 30, and arms 32 pivotal in the end plates 24 are engageable with surfaces 34 on the main frame to retain the lateral frame in its limiting uppermost elevated position illustrated in solid lines.

A chain drive 36 is mounted on the end plates of the central and lateral frames at the head end, and an identical chain drive 38 is mounted on the end plates at the foot ends of the central and lateral frames. Each drive has an endless chain 40 connecting between sprockets such as 42 pivotal in the central frame and sprockets 44 pivotal in the lateral frames. Sprockets 46 are pivotal on the central frame. Sprockets 48 are also pivoted in the central frame, and are located to accommodate the changes in the course direction of the chain 40 from horizontal over the central frame to other directions forming angles to the horizontal and corresponding to the angular positions of the lateral frames relative to the central frame. The sprockets 48 are located so that the upper course of the chain on the lateral frame forms a straight line with the upper course of the chain on the central frame when the lateral frame is in its horizontal limiting position illustrated in FIG. 8 by the broken lines 30.

Figure 9:
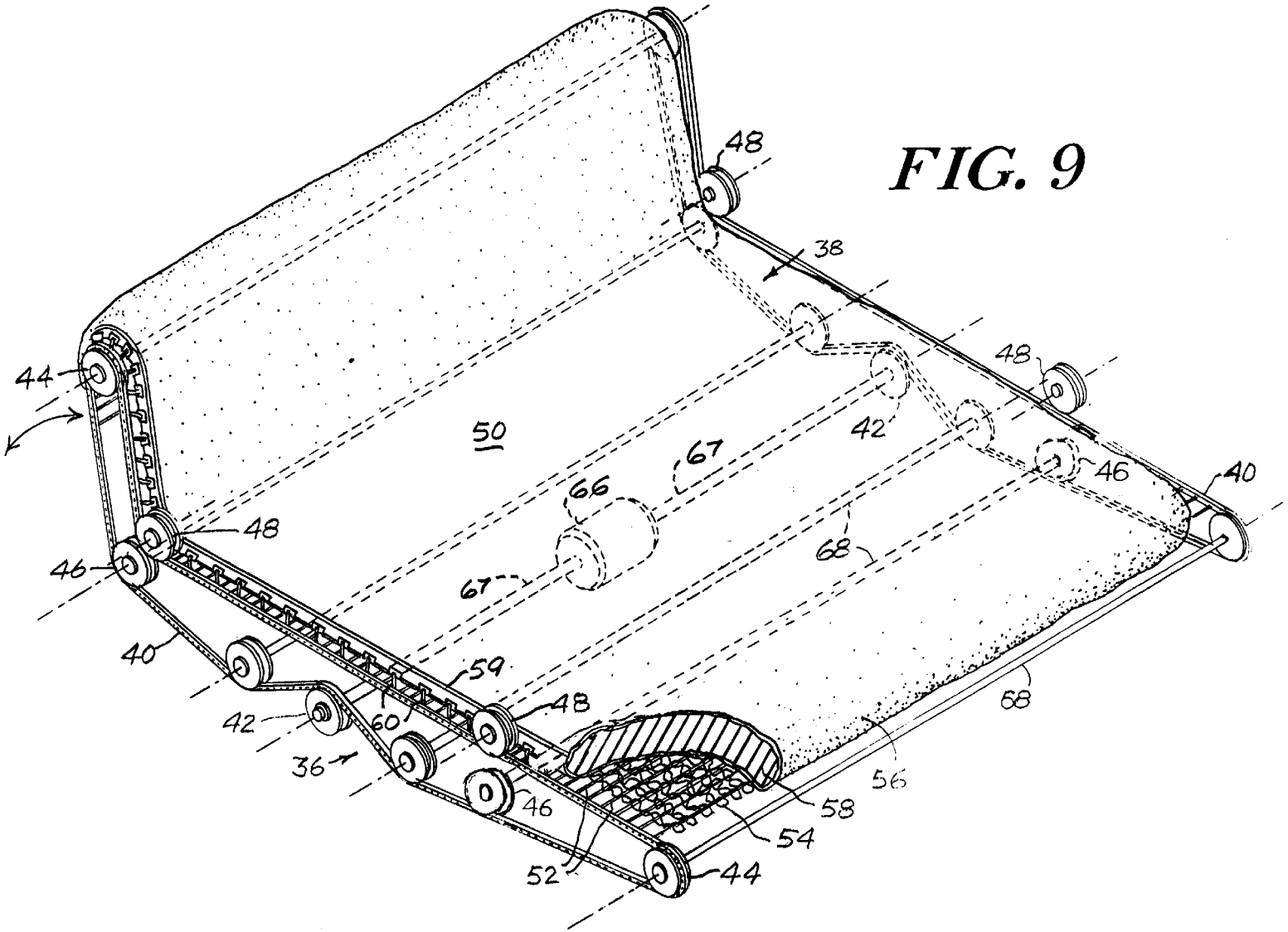
FIG. 9 is an isometric view showing the mattress transport mechanism with one form of mattress support.

A flexible mattress support 50 (FIG. 9) extends the length of the bed and is attached to the chains 40 along its head and foot edges. The means of attachment are adapted to permit the mattress support to follow the courses of the chains over the sprockets as the lateral frames are pivoted between the horizontal and various vertically elevated positions of the latter relative to the central frame.

Figure 10:
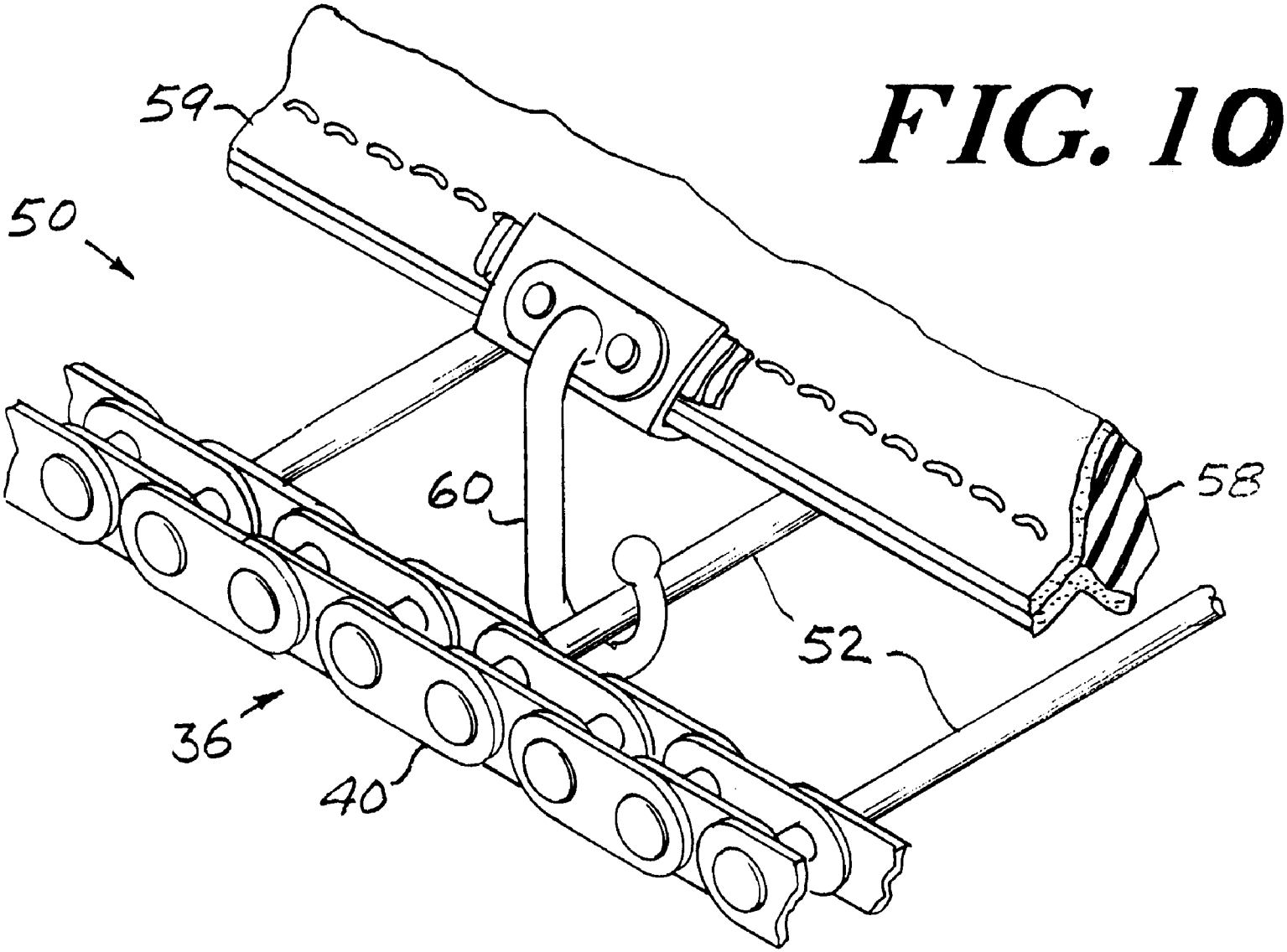
FIG. 10 is a fragmentary detail view of the means for attaching the mattress support of FIG. 10 to the chain drives.

In the presently preferred embodiment the mattress support includes a plurality of evenly spaced rods 52 joining links in the chain 40 as shown in FIG. 10. The rods 52 are threaded through a wire mesh 54. A pad 56 which optionally contains a quilting or padding material 58 is stretched over the mesh 54, and has a reinforced fabric end binding 59 with attached, uniformly spaced hooks 60 engageable with the rods 52 at suitable intervals.

A mattress 62 (FIG. 8A) is attached to the surface of the mattress support pad 56, preferably by spaced strips 64 of hook and loop material such as material sold under the trademark Velcro, the attachment being sufficient to prevent lateral shifting of the mattress relative to the mattress support during the lateral transport movements. The means of attachment preferably permit the easy replacement of the mattress from time to time as required.

A drive motor 66 is preferably centrally located under the central frame 10, and has shaft extensions 67 for simultaneously driving sprockets 42 on the chain drives 36 and 38. Other sprockets at the head end of the chain drive 36 may also be coupled by shafts such as 68 (FIG. 9) to corresponding sprockets at the foot end, as desired. The motor 66 is preferably electrically driven through suitable switch controls (not shown) which may be computer programmed to operate the motor selectively at spaced intervals, to reverse the direction of rotation to move the mattress in either direction, and to operate the motor for selectively variable periods of time according to the desired extent of lateral movement of the mattress. Alternatively, where electrical power is not available the sprockets may be turned manually through conventional gear linkages (not shown) affording a suitable mechanical advantage for the caregiver.

FIGS. 1 to 3, 4 and 6 illustrate a lower frame structure which may be employed optionally to support, raise, lower and tilt the central and lateral frames described above in cases where these additional movements are desired. The lower frame shown generally at 68 is provided with wheels 70 for moving the bed, and an articulated lever mechanism. The lever mechanism is composed of pairs of scissors-shaped arms 72, each arm of a pair being pivotally attached to the other at a point 74. The arms of each pair have one end pivotally attached to plates 76 and 78 respectively attached to upper and lower members 80 and 82.

At their opposite ends the arms are provided with rollers 84 and 86 (FIG. 1) respectively bearing on plates 88 and 90 attached to the members 80 and 82. Plates 92 and 94 are respectively secured to the upper and lower members 80 and 82, and the pairs of plates 76, 78 and 92, 94 are located to abut one another in the lower position shown in FIG. 2.

Figure 2:
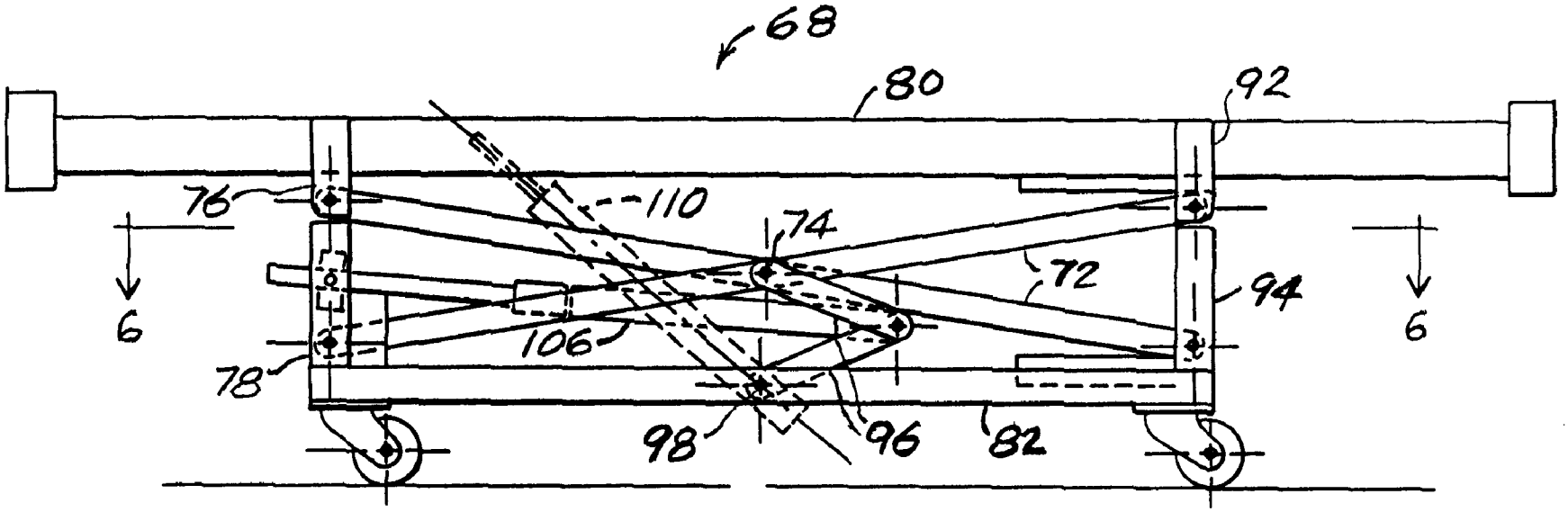
FIG. 2 shows the frame of FIG. 1 in the lowermost position.

Pairs of bars 96 are pivoted together at one end and have their other ends respectively pivoted at the joints 74 of the bars 72 and at points 98 on the lower member 82. The bars 96 are pivoted on a shaft 100 (FIG. 6), this shaft being attached by members 102 to one end of a pneumatically or hydraulically extendable device 106, the other end of which is attached to a plate 108. The plate 108 is fastened to and between the plates 78 (FIG. 2).

Figure 1:
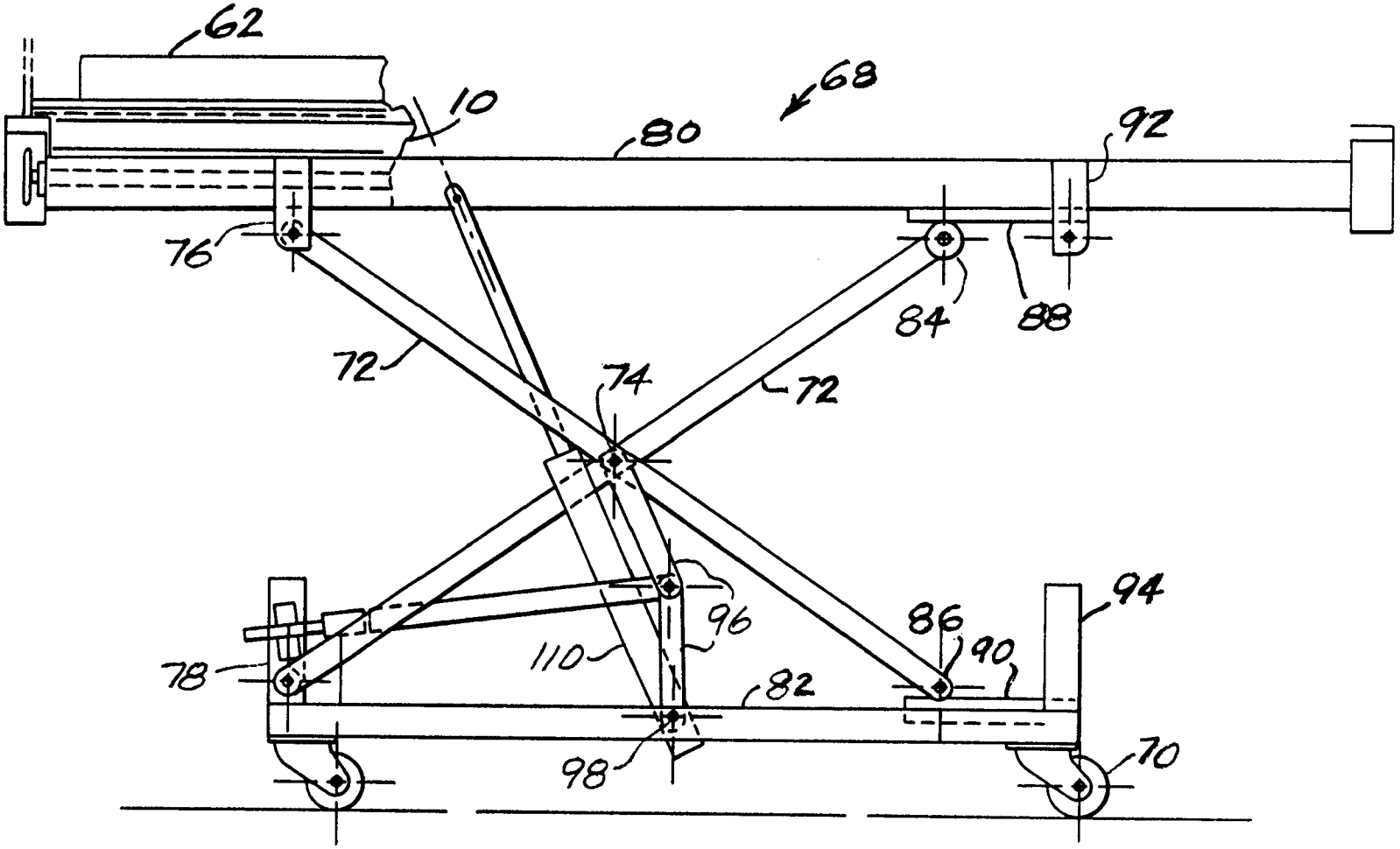
FIG. 1 is an elevation showing a lower frame mechanism adapted for raising or lowering a bed frame.
Figure 3:
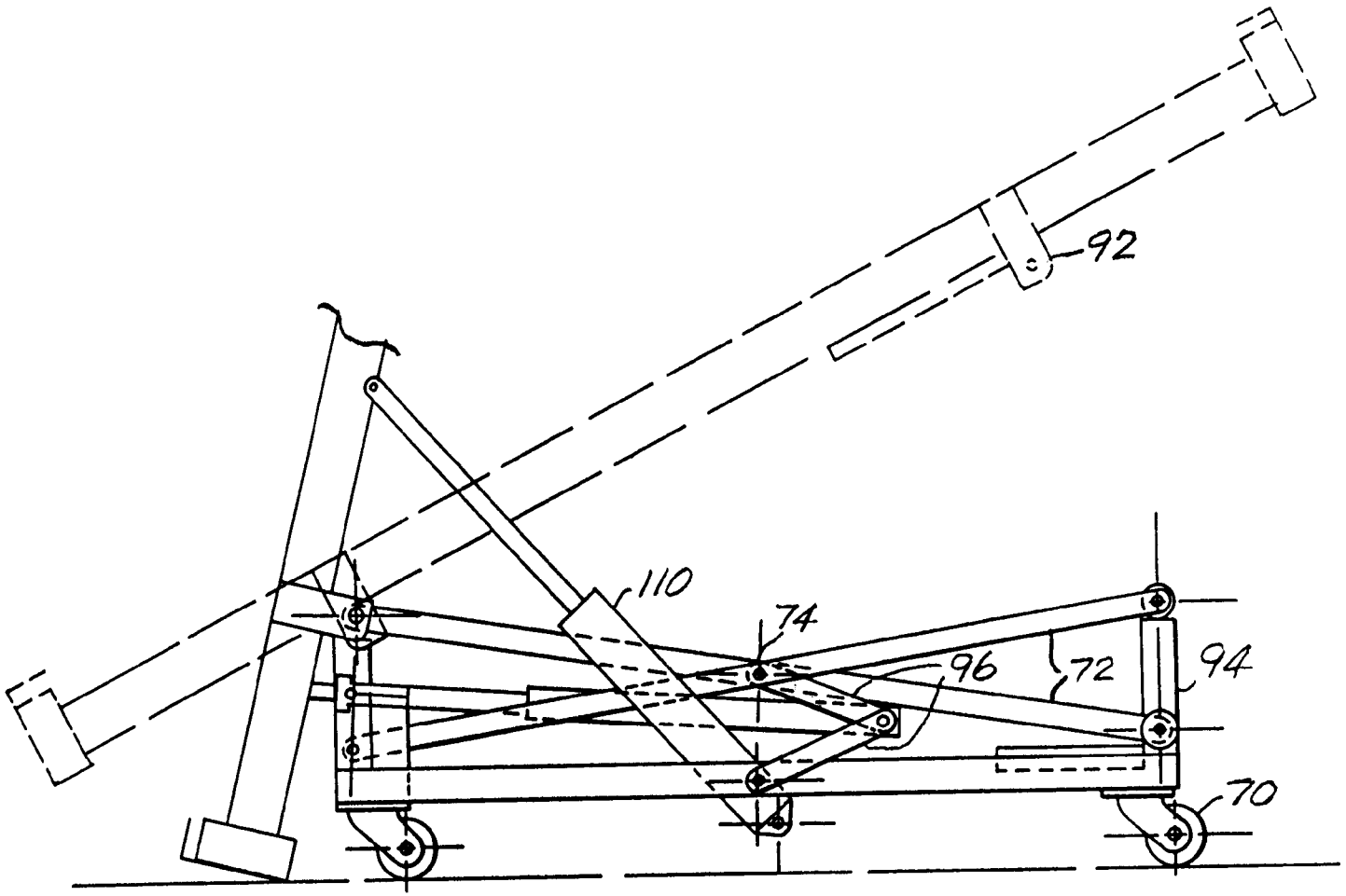
FIG. 3 shows the lower frame of FIG. 1 in position for tilting the bed frame.
Figure 4:
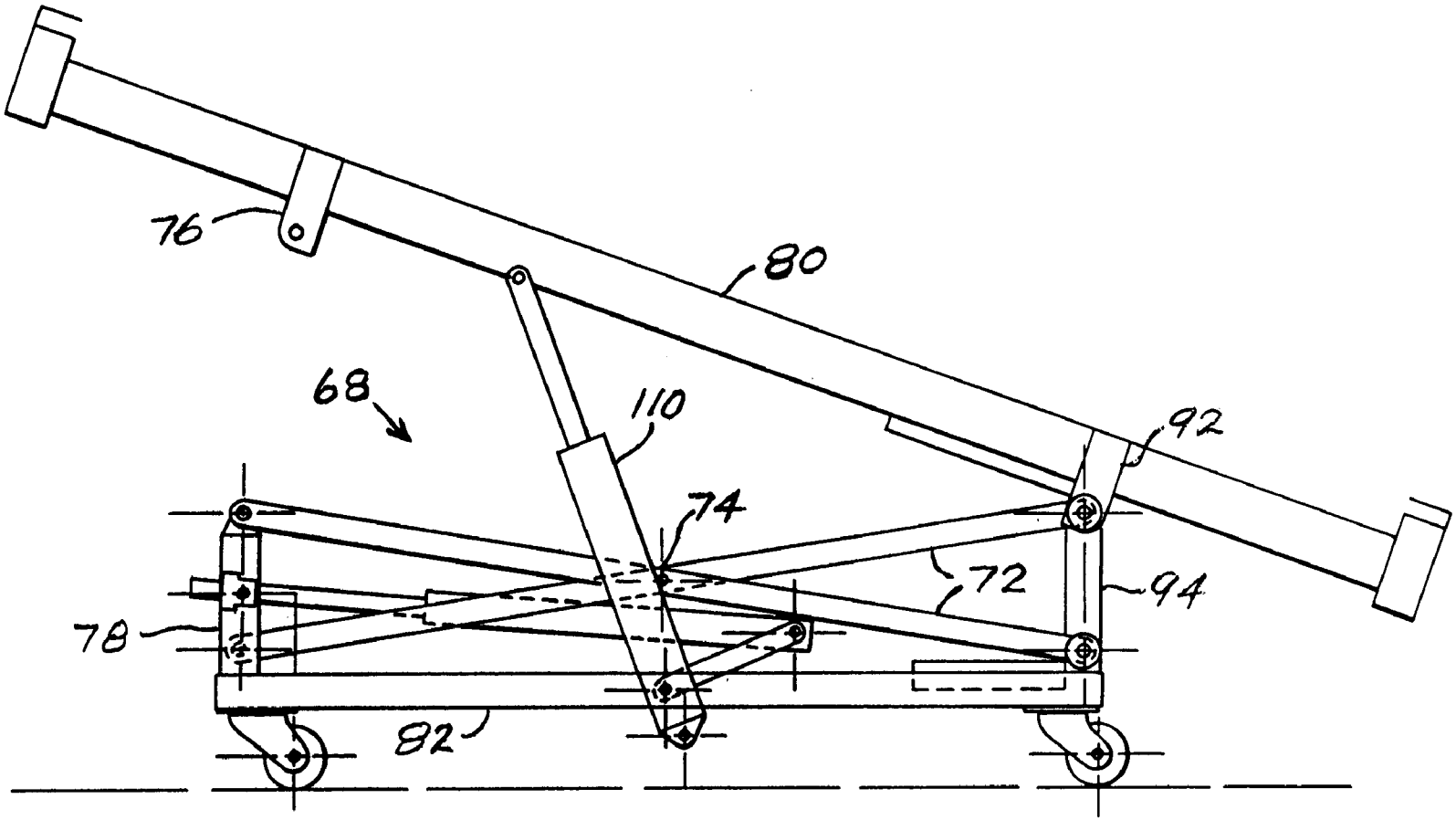
FIG. 4 shows the lower frame of FIG. 4 in position for tilting the bed frame in an opposite direction.
Figure 5A:
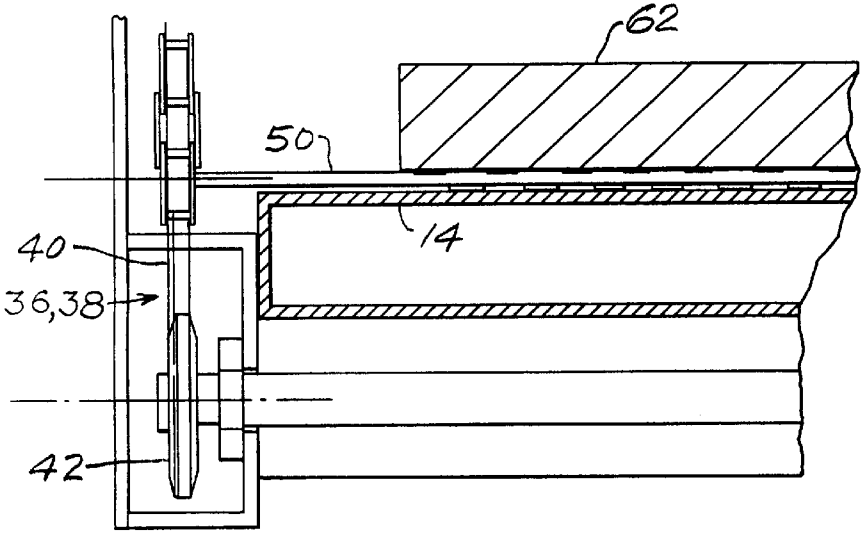
FIG. 5A is an enlarged fragmentary elevation showing one end of FIG. 5.
Figure 5:
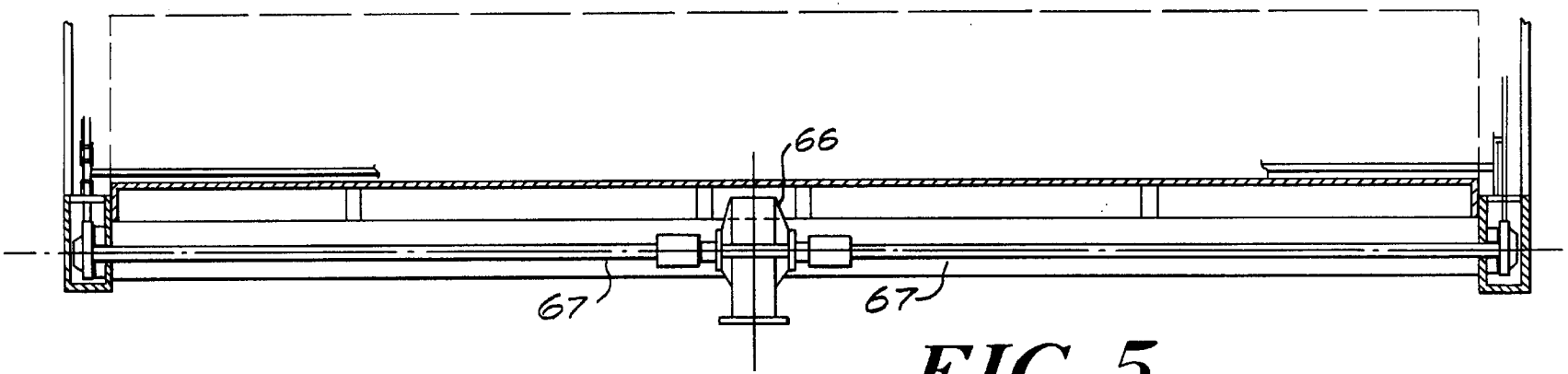
FIG. 5 is a longitudinal elevation partly in section showing the drive motor for the chain drives according to this invention.
Figure 6:
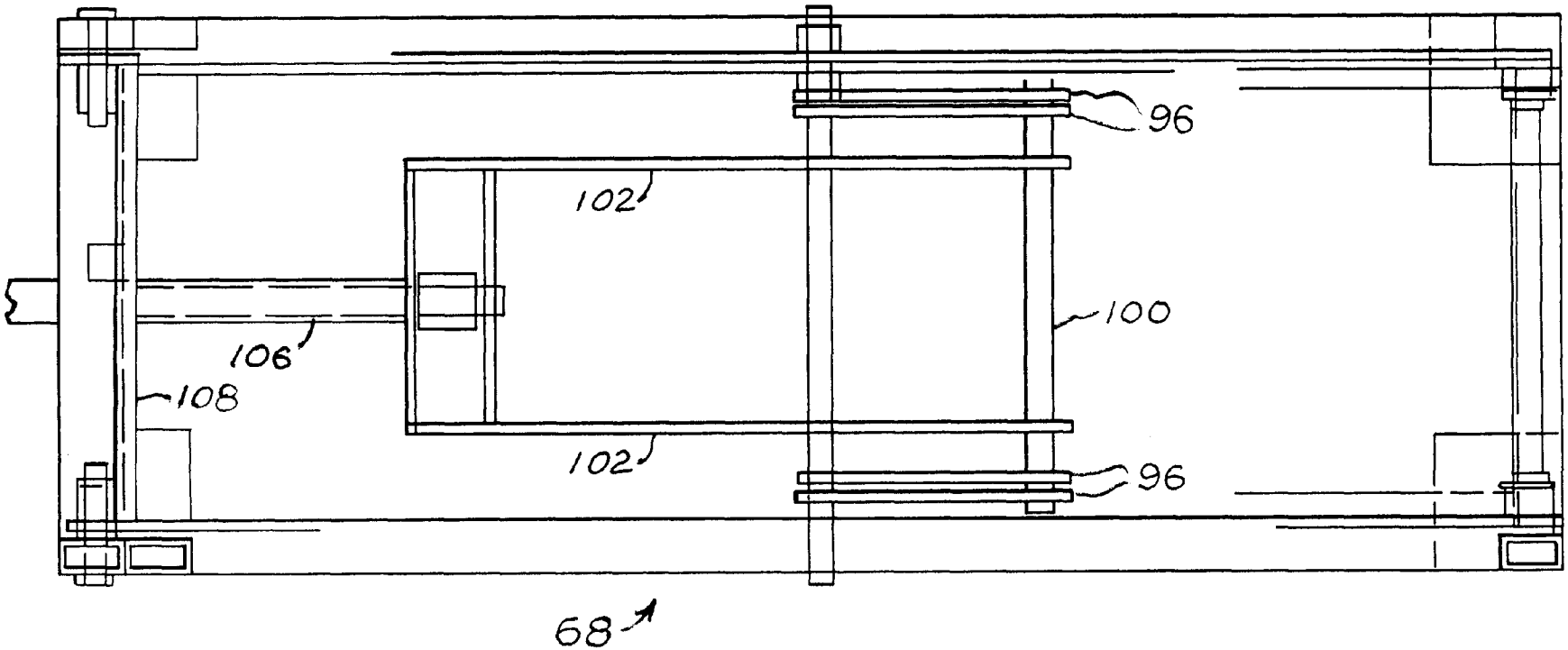
FIG. 6 is a plan view taken on line 6—6 of FIG. 2.

Pneumatically or hydraulically extendable actuators 110, respectively pivotally attached to the upper and lower members 80 and 82, are provided for tilting the member 80 and the central and lateral frames of the bed. For this purpose the plates 92 have means for pivotal attachment to or detachment from the ends of the arms 72 as shown in FIGS. 4 and 3, respectively. Similarly, the plates 76 have means for pivotal attachment to or detachment from the other ends of the bars 72 as shown in FIGS. 1 and 4, respectively.

Thus the actuation of the device 106 permits the raising or lowering of the upper member 80 relative to the lower member 82 by the sliding of the rollers 84 and 86 on the plates 88 and 90, respectively. The pairs of plates 76, 78 and 92, 94 engage one another in the lower position of the mechanism. This assists in the transfer of the patient into the bed or to a wheelchair, for example. Actuation of the devices 110 adjusts the inclination of the upper member 80 relative to the lower member to help the patient with treatments or to hold the patient in an upright position.

What is claimed is:

1. A transport mechanism for turning a patient resting on a mattress comprising, in combination, a longitudinally extending central frame, at least one longitudinally extending lateral frame pivoted to a side of the central frame, the central and lateral frames each having chain sprockets with bearings mounted therein at head and foot ends thereof, a chain interconnecting the sprockets at the head end of said frames, a chain interconnecting the sprockets at the foot end of said frames, the at least one lateral frame being pivotal to cause the courses of the chains over the lateral frame to form variable angles with the courses thereof over the central frame, a flexible mattress support extending longitudinally between the head and foot ends of the frames and attached at its ends to each of said chains, a flexible mattress attached to the mattress support to prevent lateral shifting therebetween and extending longitudinally between the head and foot ends of the frames, the mattress and mattress support each extending over at least the lateral extents of the central and lateral frames, means to support the at least one lateral frame in a patient turning position forming an angle with the central frame, and drive means for the sprockets to the mattress support and a patient on the mattress laterally over the central frame toward the at least one lateral frame, such that the portion of the mattress moving on the at least one lateral frame applies a vertical component of force to one side of the patient to turn the patient relative to the mattress.

2. A mechanism according to claim 1, including at least one longitudinally extending shaft connecting sprockets at the head and foot ends of the frames, whereby the chains are driven in unison.

3. A mechanism according to claim 2 in which said shaft is located centrally of the central frame and the drive means comprise a motor connected to said shaft.

4. A mechanism according to claim 1, in which said sprockets include sprockets pivotal on the same axis as the at least one lateral frame.

5. A mechanism according to claim 1, including a pressure actuated piston attached between the central frame and the at least one lateral frame and operable to apply lifting force to the at least one lateral frame.

6. A mechanism according to claim 1, including latching means pivotal on the at least one lateral frame and engageable with the central frame to retain the at least one lateral frame at a maximum elevation with respect thereto.

7. A mechanism according to claim 1, including longitudinally extending lateral frames pivoted to both sides of the central frame.

8. A mechanism according to claim 7, in which the lateral frames are independently pivotal on the central frame.

9. A mechanism according to claim 1, in which the at least one lateral frame is pivotal to a horizontal position in which the upper courses of the chains on the at least one lateral frame form straight lines with the upper courses thereof on the central frame.

10. A mechanism according to claim 9, including an abutment on the central frame engageable by the at least one lateral frame in said position.

11. A mechanism according to claim 1, in which the mattress support includes a plurality of evenly spaced, longitudinally extending rods, the ends of the rods being attached to the chains.

12. A mechanism according to claim 11, in which the rods are threaded through a metal mesh fabric.

13. A mechanism according to claim 1, including a lower frame supporting the central frame and having articulated bars adapted for raising and lowering the central and lateral frames.

14. A mechanism according to claim 13, in which said articulated bars are adapted for raising and lowering the head end of the central and lateral frames with respect to the foot end thereof.

* * * * *